United States Patent [19]

Hayasaka et al.

[11] Patent Number: 5,004,453

[45] Date of Patent: Apr. 2, 1991

[54] CENTRIFUGE

[75] Inventors: Hiroshi Hayasaka; Akio Nagata, both of Katsuta, Japan

[73] Assignee: Hitachi Koko Company, Limited, Japan

[21] Appl. No.: 385,743

[22] Filed: Jul. 27, 1989

[30] Foreign Application Priority Data

| | | | |
|---|---|---|---|
| Jul. 29, 1988 | [JP] | Japan | 63-101310[U] |
| Jul. 29, 1988 | [JP] | Japan | 63-191231 |
| Jul. 29, 1988 | [JP] | Japan | 63-191232 |
| Jul. 29, 1988 | [JP] | Japan | 63-101311[U] |
| Sep. 9, 1988 | [JP] | Japan | 63-119108[U] |

[51] Int. Cl.[5] ..... B04B 7/02

[52] U.S. Cl. ..... 494/39; 494/60

[58] Field of Search ..... 494/60, 61, 85, 63, 494/38, 39; 922/72

[56] References Cited

U.S. PATENT DOCUMENTS

| | | | |
|---|---|---|---|
| 2,878,992 | 3/1959 | Pickels et al. . | |
| 3,322,338 | 5/1967 | Stallman et al. . | |
| 4,196,844 | 4/1980 | Jacobson | 494/60 |

*Primary Examiner*—Robert W. Jenkins

*Attorney, Agent, or Firm*—Lowe, Price, LeBlanc, Becker & Shur

[57] ABSTRACT

A centrifuge includes an outer frame defining therein a rotor chamber, a centrifuge rotor detachably disposed in the rotor chamber, and a door slidably mounted on the frame for opening and closing the rotor chamber. The door projects outwardly from the frame when it is disposed in an open position. Since the door is received within the frame when it is fully closed, it does not enlarge the necessary space for installation of the centrifuge.

11 Claims, 4 Drawing Sheets

CENTRIFUGE

BACKGROUND OF THE INVENTION

The present invention relates generally to centrifugal separators or centrifuges, and more particularly to a centrifuge having a sliding door mechanism for sealing and protecting a rotor chamber in which a centrifuge rotor is disposed.

Centrifugal separators or centrifuges of the type described are known as disclosed, for example, in U.S. Pat. Nos. 2,878,992 and 3,322,338. The known centrifuges include, as reillustrated here in FIG. 8 of the accompanying drawings, a door 36 disposed above a rotor chamber 37 and slidably movable along guide rails 38 in opposite directions indicated by the arrowheads 39 for opening and closing the rotor chamber 37. The door 36 is always held within an outer frame 40 of the centrifuge regardless of its position relative to the rotor chamber 37. With this arrangement, the frame 40 must have a width which is at least the same as the sum of the width of the door 36 and an extent of sliding movement of the door 36, so that the door 36 can be held on the frame 40 when it is fully opened. The frame 40 of this construction is large in size and hence makes it difficult to reduce the overall size of the centrifuge.

Furthermore, the door 36 has a handle 41 in the shape of a lever pivotally connected by a vertical pin 42 to the door 36 adjacent to the rear end thereof. The pivoted handle 41 has one end engageable with a block 43 secured to the frame 40 when it is moved in a door opening direction. To open the door 36, the handle 41 is turned counterclockwise in FIG. 8 about the pin 42 whereupon the end of the handle 41 abuts against the block 43. This angular movement of the handle 41 causes front and rear rollers 44, 45 to roll along the respective guide rails 38, thereby starting sliding movement of the door 36 in a door opening direction. Thereafter, the handle 41 is forced rearwardly of the frame 40 until the door 36 is fully opened. Since the handle 41 is disposed at the rear end portion of the door 36, and since the handle 41 projects sideways from the door 36, it occupies a large space for movement thereof. The handle 41 of the foregoing construction does not contribute to the reduction of the size of the frame 40.

SUMMARY OF THE INVENTION

With the foregoing difficulties in view, a primary object of the present invention is to provide a centrifuge which is compact and hence occupies only a small space for installation thereof.

Another object of the present invention is to provide a centrifuge having a sliding door mechanism which makes it possible to reduce the size of an outer frame of the centrifuge.

According to the present invention, a centrifuge includes an outer frame defining therein a rotor chamber, a centrifuge rotor detachably disposed in the rotor chamber, and a door slidably mounted on the frame for opening and closing the rotor chamber. The door projects outwardly from the frame when it is disposed in an open position.

According to a preferred embodiment of the invention, the centrifuge further includes a pair of parallel spaced guide rails mounted on the frame for guiding therealong the door, the guide rails having respective rear ends terminating short of a rear end of the frame, and a guide roller rotatably mounted on the frame adjacent to the rear end thereof and rollingly engageable with the underside of the door for supporting thereon the door when the door projects outwardly from the frame.

According to another preferred embodiment, the door has a door handle pivotally mounted on an upper side of the door adjacent to a front end thereof and pivotally movable in a vertical plane in a direction substantially the same as the direction of movement of the door, and a bolt slidably mounted on the door and movable in a direction opposite to the direction of movement of said door in response to pivotal movement of the door handle. When the door handle is pivoted in a door opening direction, the bolt engages with a portion of the frame to cause the door to be displaced in the door opening direction.

Many other advantages and features of the present invention will become manifest to those versed in the art upon making reference to the detailed description and the accompanying sheets of drawings in which preferred structural embodiments incorporating the principles of the present invention are shown by way of illustrative example.

DESCRIPTION OF THE PREFERRED EMBODIMENTS

Figure 1:
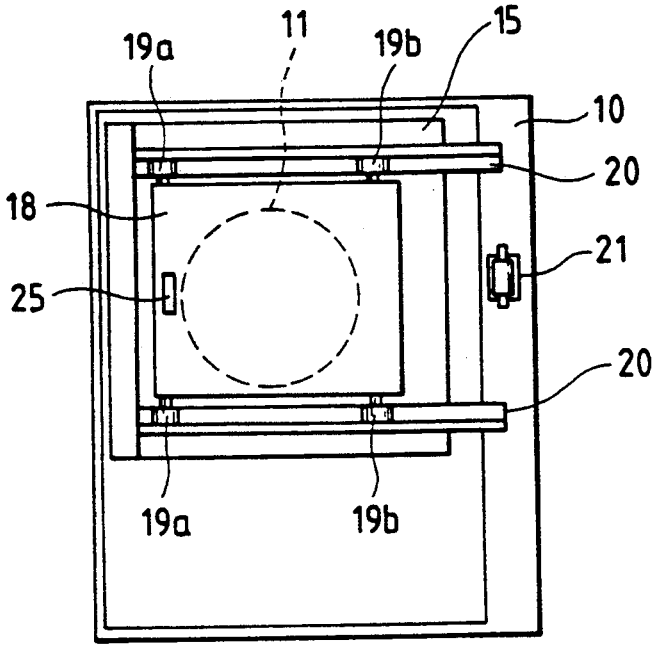
FIG. 1 is a schematic plan view, with certain parts omitted for clarity, of a centrifuge according to the present invention.
Figure 2:
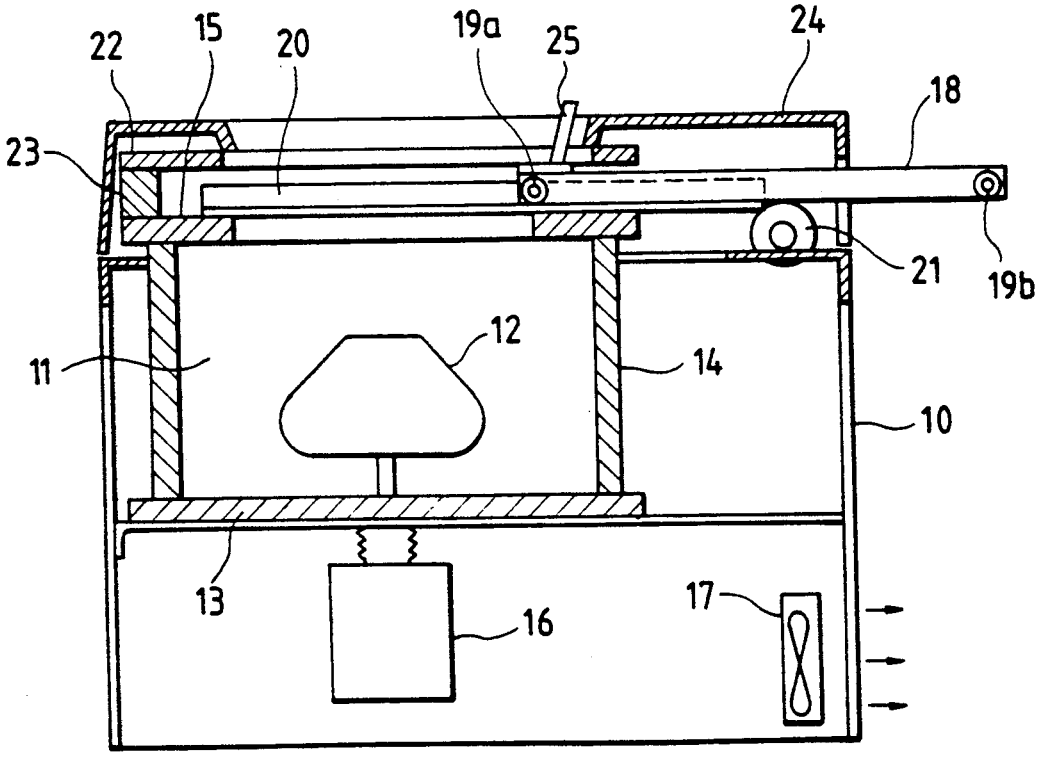
FIG. 2 is a vertical cross-sectional view of the centrifuge shown in FIG. 1.

Referring now to the drawings, wherein like reference characters designate like or corresponding parts throughout several views, FIGS. 1 and 2 schematically show a centrifuge according to the present invention.

The centrifuge includes an outer frame 10 of a substantially box-like shape having defined therein a rotor chamber 11 in which a centrifuge rotor 12 is detachably disposed. As shown in FIG. 2, the rotor chamber 11 includes a bottom plate 13 secured horizontally to the frame 10, a hollow cylindrical side wall 14 disposed on the bottom plate 13, and a top plate 15 secured to an upper end of the side wall 14. The top plate 15 has a central opening (not designated) through which the centrifuge rotor 12 may be installed and removed. The centrifuge rotor 12 is operatively connected to a drive unit 16 and adapted to be rotated at high speeds by the drive unit 16. The drive unit 16 is cooled by air streams produced by a cooling unit such as a fan 17 disposed at a lower portion of the frame 10. The rotor chamber 11 is cooled by a refrigeration unit, not shown, disposed at the lower portion of the frame 10. The rotor chamber 11 may be kept under evacuated condition.

The centrifuge further includes a door 18 slidably mounted on the frame 10 for opening and closing the rotor chamber 11. The door 18 has a rectangular shape and includes a pair of front rollers 19*a*, 19*a* adjacent to the front end (on the left side in FIG. 1) and a pair of rear rollers 19*b*, 19*b* adjacent to the rear end thereof. The front and rear rollers 19*a*, 19*b* are rollingly supported on and guided along a pair of parallel spaced guide rails 20, 20 secured to the top plate 15 of the rotor chamber 11. The guide rails 20 have respective rear ends portions projecting outwardly from the top plate 15 for guiding the door 18 as the door 18 moves toward its fully opened position. In this fully opened position, the door 18 projects rearwardly and outwardly from the frame 10, as shown in FIG. 2. A guide roller 21 is rotatably mounted on the frame 10 at a position adjacent to the respective rear ends of the guide rails 20, the guide roller 21 being disposed centrally between the guide rails 20. The guide roller 21 is rollingly engageable with the underside of the door 18 to support the door 18 when the door 18 is moved towards its fully closed position of FIG. 2. The guide roller 21 is positioned such that it is located substantially in registry with, or slightly outwardly of, the center of gravity of the door 18 when the door 18 is fully opened. In order to avoid detachment of the door 18, there is provided a guard plate 22 disposed above and extending parallel to the top plate 15. The guard plate 22 is upwardly spaced from the top plate 15 by means of a spacer block 23 disposed adjacent to the front end of the guide rails 20. A cover 24 is attached to an upper end of the frame 10 to cover an upper part of the centrifuge including the guard plate 22, the guide rails 20 and the guide roller 21. The cover 24 has a cutout recess (not designated) at its rear end for the passage therethrough of a portion of the door 18. The door 18 has a handle 25 disposed on the upper side of the door 18 adjacent to the front end thereof for manipulation of the door 18.

With the centrifuge thus constructed, the door 18 is not received within the frame 10 at all times but projects outwardly from the frame 10 when it is fully opened, as shown in FIG. 2. This means that the frame 10 does not need to have a width, which is at least equal to the sum of the width of the door 18 and an extent of sliding movement of the door 18. Consequently, a substantial reduction of the width of the frame 10 can be achieved, and hence the overall size of the centrifuge can be reduced.

Since the guide roller 21 of the foregoing embodiment is disposed substantially in registry with or slightly outwardly of the center of gravity of the door 18, it occurs likely that the door 18 after having been opened is caused to return to its closed position due to impact or shock force produced when the door 18 impinges upon the guard plate at the end of its sliding movement in a door opening direction. In order to prevent such accidental closing of the door 18, the position of the guide roller 21 is changed as shown in FIG. 3.

Figure 3:
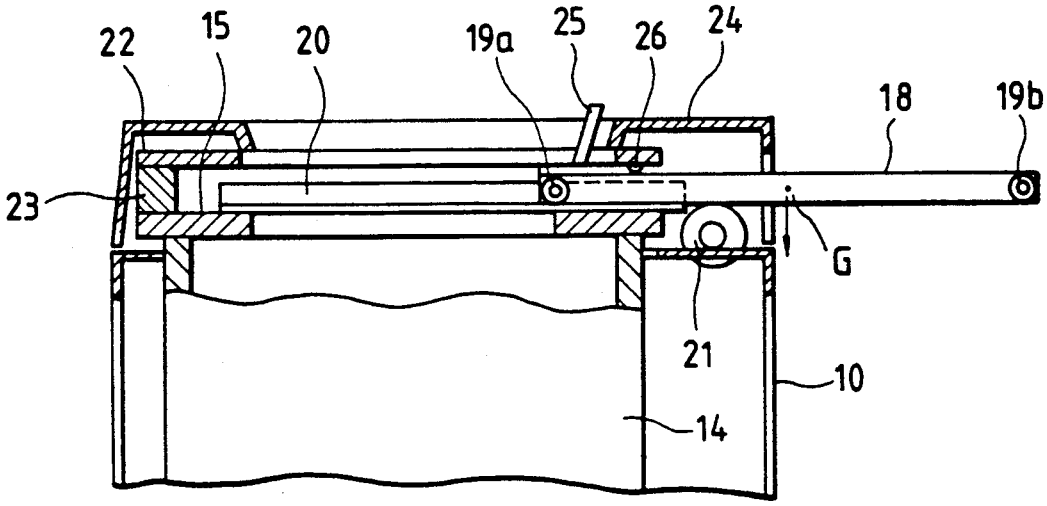
FIG. 3 is a view similar to FIG. 2, but showing a modified sliding door mechanism according to the invention.

In FIG. 3, the roller 21 is positioned such that when the door 18 is fully opened, the center of gravity G of the door 18 is disposed on the side of the guide roller 21 which is remote from the rotor chamber 11. With this placement of the guide roller 21, the door 18 tilts downwardly in such a manner, as to urge the front end of the door 18 upwardly against a resilient cushion strip 26 which is disposed on the underside of the guard plate 22 adjacent to the rear end thereof. Owing to the frictional engagement between the cushion strip 26 and the upper side of the door 18, the door 18 is stably held in position against displacement even when it is subjected to impact or shock force tending to move the door 18 in a door closing direction. Another advantage attained by the construction shown in FIG. 3 is that the overall size of the centrifuge is smaller than the centrifuge shown in FIGS. 1 and 2.

Though not shown, the guide roller 21 may be disposed in such a manner that the upper side of the guide roller 21 lies in a plane below the level of the guide rails 20. In this case, the rear end portion of the door 18 is tilted downwardly when the door 18 is fully opened.

Figure 4:
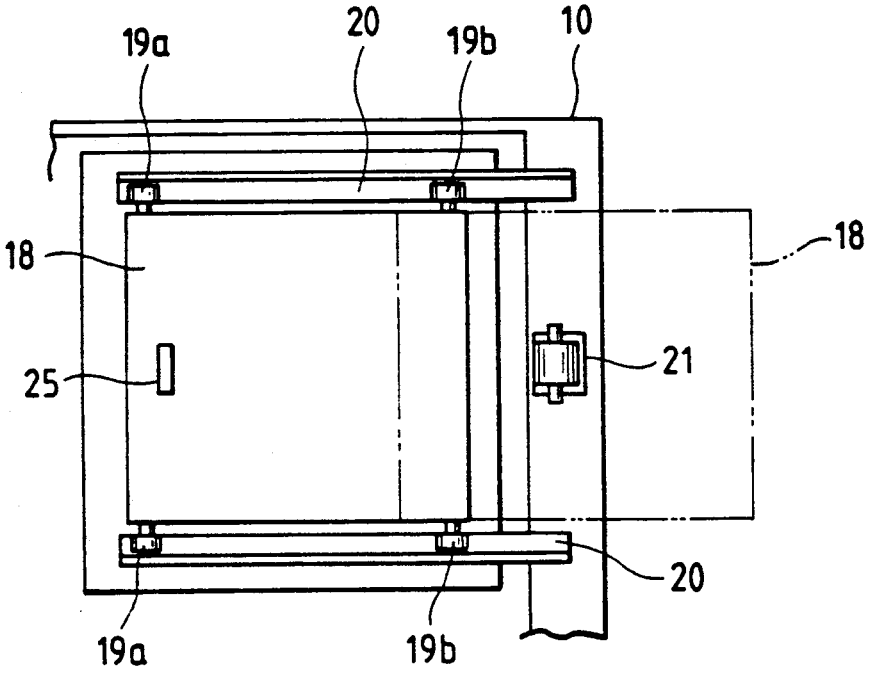
FIG. 4 is a fragmentary plan view of a centrifuge having another modified sliding door mechanism according to the invention.
Figure 5:
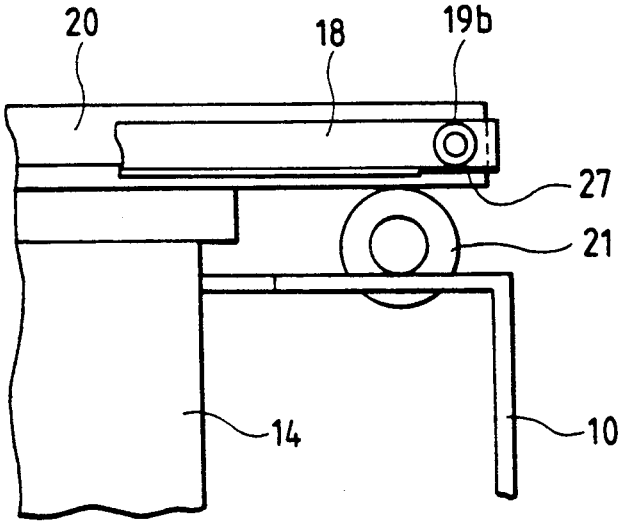
FIG. 5 is a front elevational view of a portion of the centrifuge shown in FIG. 4.

FIGS. 4 and 5 show a modified form of the centrifuge according to the present invention. The modified centrifuge is substantially the same as the centrifuge shown in FIGS. 1 and 2 with the exception that the guide rails 20 extend rearwardly beyond the guide roller 21. This arrangement is particularly advantageous when the door 18 has a sealing layer 27 on the underside along the periphery thereof for providing a hermetic seal between the door 18 and the rotor chamber 11. When the door 18 is moved rearwardly toward its fully opened position, the front and rear rollers 19*a*, 19*b* roll on and along the guide sails 20. A continued rearward movement of the door 18 causes the rear rollers 19*b* to disengage from the respective rear ends of the guide rails 20 whereupon the rear end of the door 18 falls onto the guide roller 21. In this instance, because the respective rear ends of the guide rails 20 are disposed on the rear side of the guide roller 21, the sealing layer 27 is held out of engagement with the guide roller 21 until it clears the guide roller 21. Thus, the sealing layer 27 is protected from damage which would otherwise occur due to frictional engagement with the roller 21. With this damage-free sealing layer 27, a hermetic seal provided between the door 18 and the rotor chamber 11 can be maintained for a prolonged period of time. This is particularly advantageous when the rotor chamber 11 is to be kept under evacuated condition.

Figure 6:
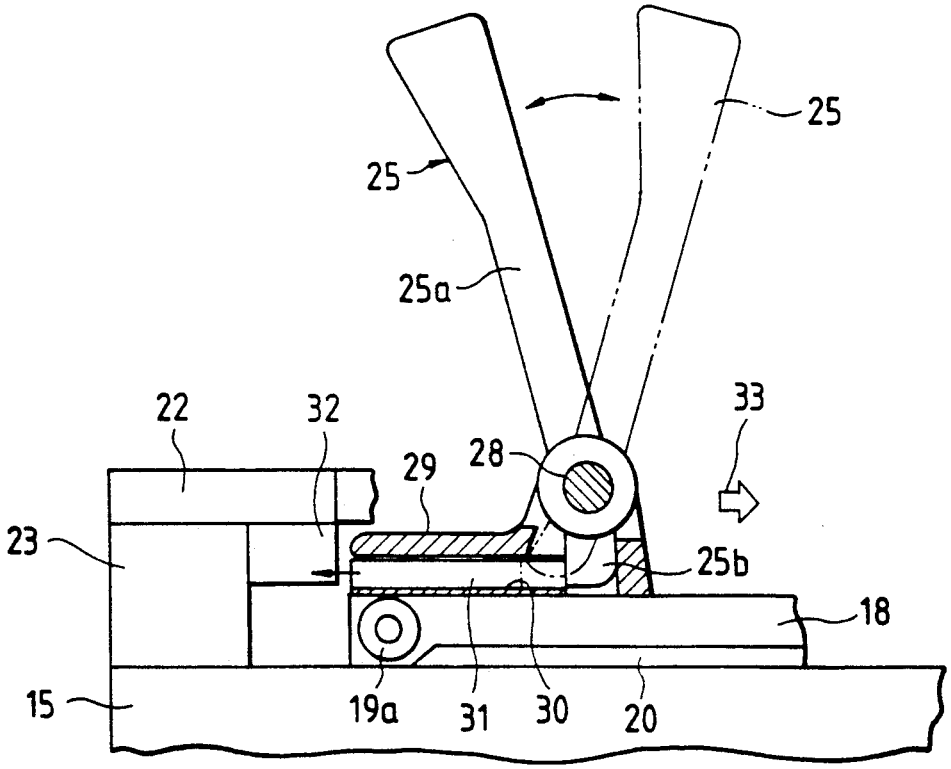
FIG. 6, appearing with FIG. 3, is an enlarged front elevational view of a modified door handle according to the invention.

FIG. 6, appearing with FIG. 3, shows a modified door handle 25 according to the present invention. The door handle 25 is in the form of an enongate lever which is pivoted by a horizontal pin 28 to a base 29 at a portion near the lower end thereof. The base 29 is disposed on the upper side of the door 18 adjacent to the forward end thereof and has a horizontal slot or hole 30 in which a bolt 31 is slidably received. The bolt 31 is normally urged by a spring (not shown) against the lower end portion of the door handle 25. The bolt 31 is engageable with an abutment piece 32 secured to the spacer block 23 adjacent to the respective forward ends of the guide rails 20 when the door handle 25 is tilted in a direction to open the door 18.

The door handle 25 is pivotally movable about the pin 28 between a forwardly tilted position indicated by the solid lines in FIG. 6, and a rearwardly tilted position indicated by the phantom lines in the same figure. The door handle 25 is normally held in the forwardly tilted position under the force of the non-illustrated spring acting on the bolt 31. The door handle 26 has an upper portion 25*a* extending upwardly from the pin 28 and a lower portion 25*b* extending downwardly from the pin 28, the upper portion 25*a* being considerably longer (about five times as long as) the lower portion 25b for a purpose described later on.

When the door 18 is to be opened, the door handle 25 is tilted rearwardly (in a direction indicated by the arrow 33) to turn clockwise in FIG. 6 about the pin 28. This angular movement of the door handle 25 causes the bolt 31 to project forwardly from the hole 30 and then abut against the abutment piece 32. Since the abutment piece 32 is fixed in position on the frame, a continued angular movement of the door handle 25 forces the door 18 to slide in the direction of the arrow 33, thereby causing the front rollers 19a to ride onto the respective guide rails 20. The movement of the front rollers 19a onto the guide rails 20 is smooth and requires only a small force because the upper portion 25a of the door handle 25 is considerably longer than the lower portion 25b. Thereafter, the door 18 is moved rearwardly by continuously forcing the door handle 25 in the direction of the arrow 33 until it is fully opened.

As described above, the door handle 25 is disposed adjacent to the front end of the door 18 and hence it moves only within a range of the movement of the front end portion of the door 18 which takes place within the area of the frame. The door handle 25 thus constructed does not enlarge the overall size of the centrifuge.

Figure 7:
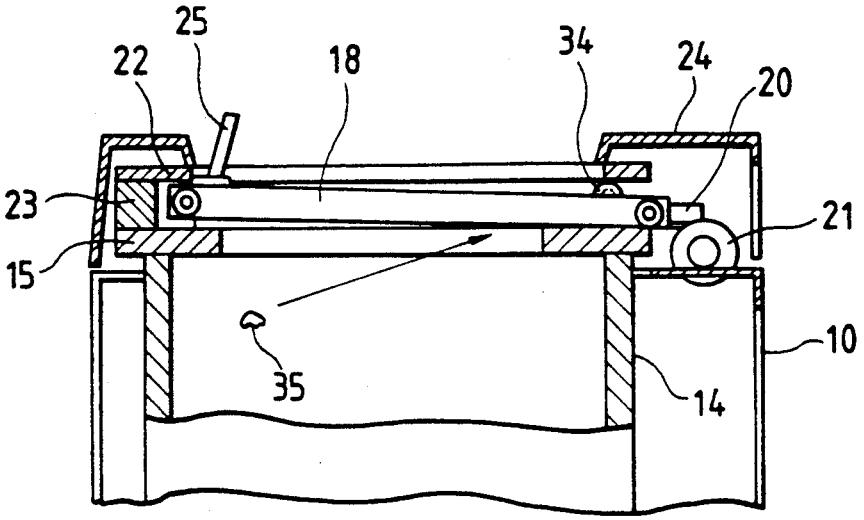
FIG. 7 is a fragmentary vertical cross-sectional view showing another modified form of the sliding door mechanism according to the present invention.
Figure 8:
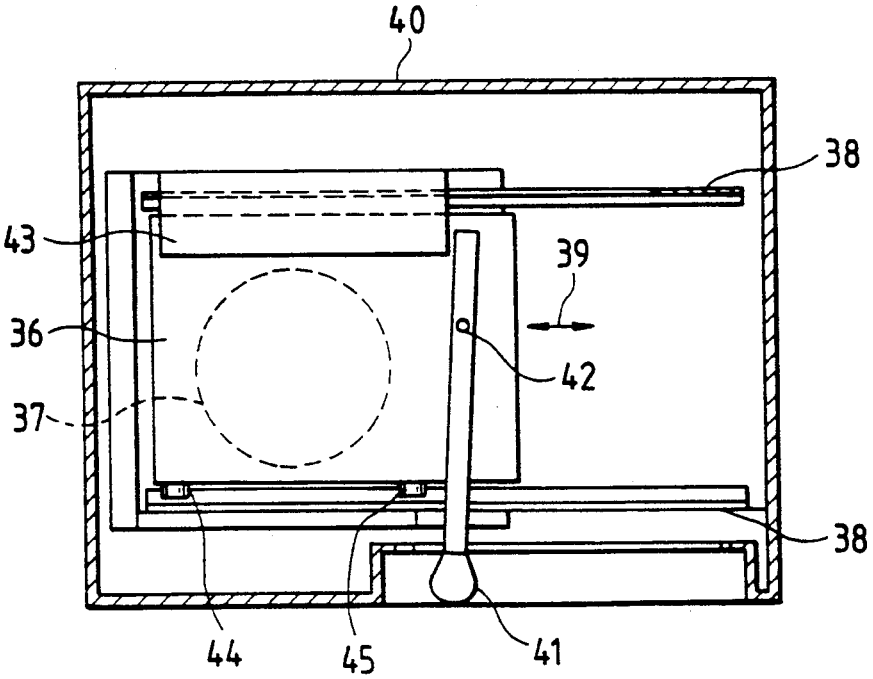
FIG. 8 PRIOR ART
FIG. 8 is a schematic plan view of a prior art centrifuge.

A modified centrifuge shown in FIG. 7 is similar to the centrifuge shown in FIGS. 1 and 2 but differs therefrom in that there is provided a cam means for urging the door 18 to tilt in a direction to sealingly close the rotor chamber 11 particularly at one side thereof which is disposed closely to the rear end of the frame 10 toward which the door 18 is moved when it is opened. The cam means comprises an arcuate projection 34 disposed on the upper side of the door 18 adjacent to the rear end thereof. When the door 18 is brought to its fully closed position, the projection 34 engages the underside of the guard plate 22 and urges the door 18 to tilt in such a manner that the front and rear ends of the door 18 sealingly engage the underside of the guard plate 22 and the upper side of the top plate 15, respectively. Thus, the rotor chamber 11 is sealed at both the front and rear sides thereof.

When the rotor (not shown but identical to the rotor 12 shown in FIG. 2) is broken due to some reasons, fragments or pieces 35 (only one shown) of the broken rotor are scattered radially outwardly. In this instance, if the door 18 were spaced from the top plate 15 at its rear end, the pieces 35 would fly out the rotor chamber 11 at a high speed through the clearance between the door 18 and the top plate 15. This is very dangerous because the operator may be injured or damaged by the flying pieces 35. According to the invention, the rotor chamber 11 is sealingly closed by the tilted door 18. Accordingly, fragments or pieces 35 of the broken rotor rebounds off the tilted door 18 and falls onto the bottom of the rotor chamber 11.

Though not shown, the projection 34 may be provided on the underside of the guard plate 22 adjacent to the rear end thereof.

Obviously, various modifications and variations of the present invention are possible in the light of the above teaching. It is therefore to be understood that within the scope of the appended claims the invention may be practiced otherwise than as specifically described.

What is claimed is:

1. A centrifuge, comprising:

(a) an outer frame defining therein a rotor chamber;

(b) a centrifuge rotor detachably disposed in said rotor (c) a door slidably mounted on said frame for opening and closing said rotor chamber, said door projecting outwardly from said frame when it is disposed in an open position;

a pair or parallel spaced guide rails mounted on said frame for guiding therealong said door, said guide rails having respective rear ends terminating short of a rear end of said frame; and a guide roller rotatably mounted on said frame adjacent to the rear end thereof and rollingly engageable with the underside of said door for supporting said door when said door projects outwardly from said frame.

2. The centrifuge of claim 1, wherein said guide roller is disposed such that it is substantially in registry with the center of gravity of said door when said door is fully opened.

3. The centrifuge of claim 1, wherein said guide roller is disposed such that when said door is fully opened, the center of gravity of said door is disposed on one side of said guide roller which is remote from said frame.

4. The centrifuge of claim 3 wherein said frame further includes a guard plate disposed above said guide rails for protecting an upper side of said door, said guard plate having a resilient cushion strip resiliently engageable with said upper side of said door.

5. The centrifuge of claim 1, wherein said door has a pair of front rollers and a pair of rear rollers rollingly movable on and along said guide rails, said guide roller being engageable with the underside of said door after said rear rollers are disengaged from the respective rear ends of said guide rails.

6. The centrifuge of claim 5, wherein said door has a sealing layer on its underside along the periphery thereof, said guide rails extending toward said rear end of said frame beyond the axis of said guide roller to such an extent that said sealing layer is held out of contact with said sealing layer until said underside of said door engages said guide roller.

7. The centrifuge of claim 1, wherein said guide roller is disposed centrally between said guide rails.

8. A centrifuge comprising:

(a) an outer frame defining therein a rotor chamber;

(b) a centrifuge rotor detachably disposed in said rotor chamber; and (c) a door slidably mounted on said frame for opening and closing said rotor chamber, said door having a door handle pivotally mounted on an upper side of said door adjacent to a front end thereof and pivotally movable in a vertical plane in a direction substantially the same as the direction of movement of said door, and a bolt slidably mounted on said door and movable in a direction opposite to the direction of movement of said door in response to pivotal movement of said door handle, when said door handle is pivoted in a door opening direction, said bolt being engageable with a portion of said frame to cause said door to be displaced in said door opening direction.

9. The centrifuge of claim 8, wherein said door handle is in the form of a pivot lever pivotally movable about a horizontal pin, said pivot lever having an upper portion extending upwardly from said pin and a lower portion extending downwardly from said pin and engageable with said bolt, said upper portion being substantially longer than said lower portion.

10. A centrifuge comprising:

(a) an outer frame defining therein a rotor chamber;

(b) a centrifuge rotor detachably disposed in said rotor chamber; and (c) a door slidably mounted on said frame for opening and closing said rotor chamber, said rotor chamber having a top plate, said frame including a guard plate disposed above and extending parallel to said to plate for guiding said door between said top plate and said guard plate, one of said door and said guard plate having a projection for tilting said door in such a manner that front and rear ends of said door sealingly engage said guard plate and said top plate, respectively, when said door is fully closed.

11. The centrifuge of claim 10, wherein said projection is disposed on an upper side of said door adjacent to the rear end of said door and engageable with the underside of said guard plate.

* * * * *

UNITED STATES PATENT AND TRADEMARK OFFICE

CERTIFICATE OF CORRECTION

PATENT NO. : 5,004,453

DATED : April 2, 1991

INVENTOR(S) : CENTRIFUGE

It is certified that error appears in the above-identified patent and that said Letters Patent is hereby corrected as shown below:

On the title page, item [73] should be:

Assignee: Hitachi Koki Company, Limited, Japan

Signed and Sealed this

Thirteenth Day of October, 1992

*Attest:*

DOUGLAS B. COMER

*Attesting Officer*

*Acting Commissioner of Patents and Trademarks*